US008561213B2

(12) United States Patent
Howell et al.

(10) Patent No.: US 8,561,213 B2
(45) Date of Patent: Oct. 22, 2013

(54) MULTI-PANELED PROTECTIVE UNDERGARMENT

(75) Inventors: Andrew Rhys Howell, Cardiff (GB); Matthew Searle, Bruton (GB); Christopher Mark Lewis, Cardiff (GB); William Mark Hocking, Cardiff (GB)

(73) Assignee: BCB International Limited, Cardiff (GB)

( * ) Notice: Subject to any disclaimer, the term of this patent is extended or adjusted under 35 U.S.C. 154(b) by 104 days.

(21) Appl. No.: 12/948,183

(22) Filed: Nov. 17, 2010

(65) Prior Publication Data

US 2012/0117700 A1 May 17, 2012

(51) Int. Cl.
*F41H 1/02* (2006.01)
*A41D 13/00* (2006.01)

(52) U.S. Cl.
USPC ..... 2/2.5; 2/455; 2/22; 2/401

(58) Field of Classification Search
USPC ..... 2/455, 466, 2.5, 23, 267, 400, 401, 403, 2/404, 22, 227, 228, 231
See application file for complete search history.

(56) References Cited

U.S. PATENT DOCUMENTS

| | | | | |
|---|---|---|---|---|
| 1,633,610 | A | 6/1927 | Schneider | |
| 1,657,094 | A | 1/1928 | Rutledge | |
| 1,720,439 | A | 7/1929 | Richardson | |
| 1,863,482 | A | 6/1932 | Isaacs | |
| 1,887,473 | A | 11/1932 | Warner | |
| 2,116,822 | A | 5/1938 | Berger | |
| RE21,269 | E | 11/1939 | Copeman | |
| 2,204,380 | A | 6/1940 | Pray | |
| 2,216,897 | A | 10/1940 | Zoob | |
| 2,755,475 | A * | 7/1956 | Lipshitz | 2/2.5 |
| 2,790,973 | A * | 5/1957 | Lewis, Jr. et al. | 2/2.5 |
| 2,879,654 | A | 3/1959 | Evans | |
| 3,083,710 | A | 4/1963 | Rauser | |

(Continued)

FOREIGN PATENT DOCUMENTS

| | | |
|---|---|---|
| WO | WO03/027600 | 4/2003 |
| WO | WO 2009055850 A1 * | 5/2009 |

OTHER PUBLICATIONS

Imperial Armour "Technical Specifications Imperial Armour Designer Ballistic Briefs" 1 page (Circa 2010).
Illusion Militaria "Buaer Flak Short" website available: http://www.illusion.org.cn/cp_detail.php?id=18654&nowmenuid=49087&catid=0 (Buaer Short Circa 1957).

(Continued)

*Primary Examiner* — Alissa L Hoey
(74) *Attorney, Agent, or Firm* — Workman Nydegger

(57) ABSTRACT

A protective undergarment (10), shown in the form of shorts, includes integrally formed protective panels (22, 26, 30) that exhibit slash-proof properties. The protective areas (22, 26, 30) are made from a flexible Kevlar® knit or the like, and extend to cover the groin, crotch, substantial areas of the buttocks and the inner thigh regions of both legs. The protective panels (22, 26, 30) are externally snitched to a low thermal burden material (18, 20), such as a polyester mesh, that provides elasticity and completes the structure of the shorts (10). The Kevlar® knit is flexible and preferably lies directly against the skin of a user to provide blast wave and ballistic fragment deflection while permitting mobility in a lightweight arrangement. Varying thickness of the Kevlar® knit can be used in the protective areas (22, 26, 30) selectively to enhance protection against blast wave and fragment penetration. The shorts (10) find particular application in battlefield theatres where military personnel are exposed to bomb threats.

9 Claims, 1 Drawing Sheet

(56) References Cited

U.S. PATENT DOCUMENTS

| | | | | |
|---|---|---|---|---|
| 3,127,614 | A | 4/1964 | Bennett | |
| 3,331,083 | A | 7/1967 | Holly | |
| 3,418,660 | A | 12/1968 | Shumate | |
| 3,431,560 | A | 3/1969 | Austin | |
| RE26,682 | E | 10/1969 | Terry | |
| 3,509,579 | A | 5/1970 | Morgan | |
| 3,740,763 | A | 6/1973 | Mitchell | |
| 3,743,253 | A | 7/1973 | Tuckey et al. | |
| 3,771,171 | A | 11/1973 | Mitchell | |
| 3,829,899 | A | 8/1974 | Davis | |
| 4,183,097 | A * | 1/1980 | Mellian | 2/2.5 |
| 4,316,286 | A | 2/1982 | Klein | |
| 4,371,989 | A | 2/1983 | Polsky | |
| 4,460,393 | A | 7/1984 | Saget | |
| 4,475,247 | A | 10/1984 | Lee | |
| 4,488,317 | A | 12/1984 | Polsky | |
| 4,507,802 | A * | 4/1985 | Small | 2/2.5 |
| 4,516,273 | A | 5/1985 | Gregory | |
| 4,578,821 | A * | 4/1986 | Zufle | 2/2.5 |
| 4,670,913 | A | 6/1987 | Morell | |
| 4,722,099 | A | 2/1988 | Kratz | |
| 4,785,480 | A | 11/1988 | Polsky | |
| 4,843,654 | A | 7/1989 | March | |
| 5,008,959 | A * | 4/1991 | Coppage et al. | 2/2.5 |
| 5,044,011 | A * | 9/1991 | Henderson | 2/2.5 |
| 5,136,724 | A | 8/1992 | Grilliot | |
| 5,160,693 | A | 11/1992 | Eckert | |
| 5,161,257 | A * | 11/1992 | Arensdorf et al. | 2/465 |
| 5,172,426 | A | 12/1992 | Capello | |
| 5,210,877 | A | 5/1993 | Newman | |
| 5,299,602 | A | 4/1994 | Barbeau | |
| 5,327,811 | A | 7/1994 | Price | |
| 5,362,527 | A * | 11/1994 | Harpell et al. | 428/33 |
| 5,373,582 | A | 12/1994 | Dragone | |
| 5,398,339 | A | 3/1995 | Wagner | |
| 5,398,340 | A * | 3/1995 | Kibbee | 2/2.5 |
| 5,443,882 | A | 8/1995 | Park | |
| 5,443,883 | A | 8/1995 | Park | |
| 5,471,906 | A | 12/1995 | Bachner | |
| 5,495,620 | A * | 3/1996 | Schoenweiss et al. | 2/2.5 |
| 5,495,621 | A * | 3/1996 | Kibbee | 2/2.5 |
| 5,542,124 | A | 8/1996 | Grilliot | |
| 5,572,737 | A | 11/1996 | Valice | |
| 5,632,137 | A | 5/1997 | Kolmes | |
| 5,689,836 | A * | 11/1997 | Fee et al. | 2/465 |
| 5,694,981 | A | 12/1997 | Stanhope | |
| 5,754,982 | A * | 5/1998 | Gainer | 2/2.5 |
| 5,794,262 | A | 8/1998 | Capello | |
| 5,829,653 | A | 11/1998 | Kaiser | |
| 5,860,163 | A | 1/1999 | Aldridge | |
| 5,918,319 | A * | 7/1999 | Baxter | 2/455 |
| 5,926,856 | A * | 7/1999 | Duval | 2/455 |
| 5,958,804 | A * | 9/1999 | Brown et al. | 442/192 |
| 5,970,513 | A | 10/1999 | Kocher | |
| 5,974,585 | A | 11/1999 | Bachner | |
| 5,996,115 | A | 12/1999 | Mazelsky | |
| 6,026,510 | A | 2/2000 | Kocher | |
| 6,041,437 | A | 3/2000 | Barker | |
| 6,041,441 | A * | 3/2000 | Counts et al. | 2/227 |
| 6,041,442 | A | 3/2000 | Owen | |
| 6,103,641 | A * | 8/2000 | Gehring, Jr. | 442/46 |
| 6,145,132 | A * | 11/2000 | Towner | 2/400 |
| 6,260,196 | B1 * | 7/2001 | van der Sleesen | 2/2.5 |
| 6,453,791 | B1 | 9/2002 | Seitzinger | |
| 6,490,733 | B1 | 12/2002 | Casaubon | |
| 6,519,781 | B1 * | 2/2003 | Berns | 2/267 |
| 6,627,562 | B1 * | 9/2003 | Gehring, Jr. | 442/35 |
| 6,651,543 | B2 * | 11/2003 | Park | 89/36.02 |
| 6,667,255 | B2 * | 12/2003 | Hexels | 442/393 |
| 6,738,984 | B2 | 5/2004 | Gillen | |
| 6,745,394 | B1 * | 6/2004 | Rutherford | 2/2.5 |
| 6,779,330 | B1 * | 8/2004 | Andrews et al. | 57/210 |
| 6,841,492 | B2 | 1/2005 | Bhatnagar | |
| 6,861,378 | B2 | 3/2005 | Cunningham | |
| 6,961,958 | B1 * | 11/2005 | Seitzinger | 2/2.5 |
| 7,010,811 | B1 * | 3/2006 | Park | 2/2.5 |
| 7,017,193 | B2 * | 3/2006 | Auger | 2/403 |
| 7,043,766 | B1 * | 5/2006 | Foreman et al. | 2/81 |
| 7,073,538 | B2 * | 7/2006 | Bhatnagar et al. | 139/383 R |
| 7,150,217 | B2 * | 12/2006 | Kershaw | 89/36.05 |
| 7,181,774 | B2 | 2/2007 | Silver | |
| 7,386,894 | B2 | 6/2008 | Straiton | |
| 7,500,274 | B1 * | 3/2009 | Kallen | 2/227 |
| 7,512,995 | B2 * | 4/2009 | Deffner | 2/227 |
| 7,578,005 | B2 * | 8/2009 | Vereen | 2/69 |
| 7,589,036 | B2 | 9/2009 | Corner | |
| 7,774,865 | B2 * | 8/2010 | Miller | 2/403 |
| 7,784,116 | B2 * | 8/2010 | Gallo et al. | 2/267 |
| 7,810,167 | B2 * | 10/2010 | Seitzinger et al. | 2/2.5 |
| 7,849,522 | B2 | 12/2010 | Roux | |
| 7,937,771 | B2 | 5/2011 | Mazzarolo | |
| 7,937,780 | B2 * | 5/2011 | Matic et al. | 2/465 |
| 7,987,521 | B2 * | 8/2011 | Vereen | 2/81 |
| 8,095,996 | B2 * | 1/2012 | Turner | 2/456 |
| 8,108,947 | B2 | 2/2012 | Beauvais | |
| 8,146,176 | B2 | 4/2012 | Rudolph | |
| D663,923 | S | 7/2012 | Karik | |
| 8,347,422 | B2 | 1/2013 | Kalaam | |
| 2002/0155773 | A1 | 10/2002 | Maini | |
| 2003/0167557 | A1 | 9/2003 | LaShoto | |
| 2003/0226197 | A1 | 12/2003 | Cramer | |
| 2004/0019950 | A1 | 2/2004 | Rast | |
| 2004/0023580 | A1 * | 2/2004 | Hand et al. | 442/134 |
| 2004/0064865 | A1 * | 4/2004 | Hummel | 2/2.5 |
| 2004/0065072 | A1 | 4/2004 | Zhu | |
| 2004/0235383 | A1 * | 11/2004 | Perry et al. | 442/344 |
| 2005/0034219 | A1 * | 2/2005 | Lowry | 2/227 |
| 2005/0066408 | A1 | 3/2005 | Varela | |
| 2005/0081571 | A1 * | 4/2005 | Bhatnagar et al. | 66/202 |
| 2005/0108800 | A1 * | 5/2005 | White | 2/2.5 |
| 2005/0229293 | A1 * | 10/2005 | Miller | 2/403 |
| 2006/0000005 | A1 * | 1/2006 | Foreman et al. | 2/115 |
| 2006/0062944 | A1 | 3/2006 | Gardner | |
| 2006/0206986 | A1 | 9/2006 | Straiton | |
| 2006/0230484 | A1 * | 10/2006 | Schultz | 2/2.5 |
| 2006/0242750 | A1 * | 11/2006 | Vereen | 2/115 |
| 2006/0260026 | A1 * | 11/2006 | Doria et al. | 2/414 |
| 2007/0016996 | A1 * | 1/2007 | Seitzinger et al. | 2/2.5 |
| 2007/0094763 | A1 * | 5/2007 | Silver | 2/69 |
| 2007/0271965 | A1 | 11/2007 | Kolmes | |
| 2008/0010730 | A1 * | 1/2008 | Twito et al. | 2/463 |
| 2008/0104743 | A1 | 5/2008 | Ng | |
| 2008/0178358 | A1 * | 7/2008 | Learmont | 2/2.5 |
| 2008/0184467 | A1 * | 8/2008 | Brassill | 2/455 |
| 2008/0295210 | A1 * | 12/2008 | Matic et al. | 2/2.5 |
| 2008/0295231 | A1 * | 12/2008 | Wright | 2/455 |
| 2009/0013451 | A1 * | 1/2009 | Baxter et al. | 2/455 |
| 2009/0025126 | A1 * | 1/2009 | Crossman et al. | 2/456 |
| 2009/0075019 | A1 | 3/2009 | Loos | |
| 2010/0000001 | A1 * | 1/2010 | Sonner | 2/2.5 |
| 2010/0043116 | A1 * | 2/2010 | Vereen | 2/81 |
| 2010/0050699 | A1 | 3/2010 | Kolmes | |
| 2010/0175430 | A1 | 7/2010 | Garcia | |
| 2010/0186134 | A1 * | 7/2010 | Hunter et al. | 2/2.5 |
| 2010/0206472 | A1 * | 8/2010 | Kim | 156/247 |
| 2010/0212056 | A1 * | 8/2010 | Sullivan | 2/2.5 |
| 2010/0229273 | A1 * | 9/2010 | Crye | 2/2.5 |
| 2010/0325766 | A1 | 12/2010 | Mackintosh | |
| 2011/0072545 | A1 * | 3/2011 | Bennett | 2/2.5 |
| 2011/0131694 | A1 * | 6/2011 | Fearon | 2/2.5 |
| 2011/0167545 | A1 | 7/2011 | Garcia | |
| 2011/0277202 | A1 * | 11/2011 | McQueer | 2/2.5 |
| 2012/0117700 | A1 | 5/2012 | Howell | |
| 2012/0260400 | A1 * | 10/2012 | Franz | 2/228 |
| 2013/0074251 | A1 | 3/2013 | Crye | |
| 2013/0212791 | A1 | 8/2013 | Hocking | |

OTHER PUBLICATIONS

U.S. Appl. No. 13/624,363, Mail Date Feb. 20, 2013, Office Action.
U.S. Appl. No. 12/999,718, Mail Date Apr. 17, 2013, Office Action.
U.S. Appl. No. 13/624,363, mailed Sep. 6, 2013, Final Office Action.

* cited by examiner

MULTI-PANELED PROTECTIVE UNDERGARMENT

BACKGROUND OF THE INVENTION

1. The Field of the Invention

This invention relates, in general, to multi-paneled protective undergarments and is particularly, but not exclusively, applicable to flexible reinforced undergarments such as abdominal body armour (in the form of trunks or shorts) which includes protective, armour-like areas for the groin, buttocks, crotch and upper thighs.

2. Background of the Invention

With great regret, a rise in worldwide terrorism has seen an increased use of improvised explosive devices ("IEDs"); these are also known as roadside bombs due to their deployment. Such IEDs essentially contain an explosive attached to a detonating mechanism, and cause severe external and internal body traumas from several effects, principally: the blast pressure wave and the fragmentation effect. The fragmentation effect leads to penetrating ballistic or blunt force injuries that arise from impacts with projectiles included in the container, projectiles produced from the destruction of the container and from objects surrounding the detonator and target.

IEDs are therefore of considerable concern and present a real threat to both civilians and, more particularly, military or police personnel.

With respect to likely injuries sustained in an explosion, primary blast injury is a direct result of the over-pressurization waves' impact on the body. These injuries occur mainly to the gas-filled organs, including the gastrointestinal systems and colonic track, and arise (for example) from the blast wave being channeled into the body. Particularly, injuries result from spalling, implosion, inertia and the extreme pressure differentials at the body surfaces causing a stress wave that is produced in the underlying tissues. Also, IEDs can cause traumatic amputation (of a leg or genitalia) and potential bleed-out when a body-part is severed following an explosion. Indeed, with respect to leg injuries, the location of the femoral artery in the upper leg and the overall circumference of the thigh often inhibit the application of a tourniquet used conventionally and initially to stem the flow of traumatic bleeding in advance of surgery.

Protection of the groin, crotch region, buttocks and upper thigh are therefore equally important, but conventional plate-armour, besides being heavy, is generally considered restrictive of movement to the extent that a soldier's effectiveness may be compromised in that they are unable to run or crouch easily (when wearing such plate-based armour).

The U.S. Navy's BUAER (Bureau of Aeronautics) "Flak Shorts" were made from ballistic nylon and protected the groin and lower abdomen from low velocity fragments (see: http://www.vietnamgear.com/kit.aspx?kit=659). They had a front zip closure protected by a snap fastener cover and featured an adjustable crotch strap. The BUAER shorts were worn with a matching vest by Navy and Marine Corps aircrews early in the Vietnam War. Often referred to as "Flak Diapers", the weight (approximately 3 lbs or about 1.3 kg) and overall size of these flak diapers meant that they were rarely worn and, more often than not, were instead used as a cushion to protect air-crewmen against ground fire.

Imperial Armour SA has also marketed "ballistic underwear" (see http://www.youtube.com/watch?v=ipDrFc7Zqnk). Four-ply unidirectional fibre is cross-plied and sandwiched into a flexible film that is cut into a specific pattern. The resulting "ballistic panel" is combined with a trauma sheet that is worn next to the body. The trauma sheet therefore defines a tailored article of clothing having a pocket into which the ballistic panel is inserted. The cumulative weight of the product is in the region of 1.6 kg. The multiple layers are heat retaining, especially since trapped air acts as a thermal insulator.

In terms of leg wear design, cycling shorts are skin-tight leg wear designed to improve comfort and efficiency while cycling. Particularly, they: i) reduce wind resistance and thereby increase aerodynamic efficiency; ii) protect the skin against the repetitive friction of the legs against the bicycle seat or frame; iii) draw sweat away from the skin to prevent chafing and rashes, and to cool the rider down through the process of evaporation; iv) compress the legs, which can help combat muscular fatigue. The traditional chamois leather patch inside the shorts in the crotch area (which corresponds to the saddle region on the bike) remains popular, although synthetic chamois linings are now produced in a variety of shapes and styles to suit the needs of different rider. However, patch designs are minimized to reduce overall weight and to provide a smooth surface that is aerodynamically optimized. Modern cycling shorts are often made of stretchable spandex (Lycra® fibre), with the hem of each leg usually lined with elastic and/or elastic gel that clings to the skin keeping it in a fixed position.

By way of example, the Black Pearl Bike short (by Aero Tech Designs) is made from tricot fabric that is highly aerodynamic and hydrodynamic. The microfiber nylon is 87% micro-denier nylon and 13% spandex, with the compression supporting muscles and movement to reduce muscle fatigue and lactic acid buildup. The material blend of nylon fibers allows for a soft feel that dries quickly. A shock absorbing cellular urethane ("open-cell" structure) pad is designed to absorb shock while allowing water vapor and perspiration to move through the open cells and thus away from the body. Pads in cycling shorts can be both anti-bacterial and hypoallergenic, thereby resisting odors and reducing germ growth.

However, cycling shorts provide no protection against trauma and merely prevent chaffing and localized soreness arising from friction rubbing and related friction burns.

BRIEF SUMMARY OF THE INVENTION

According to a first aspect of the present invention there is provided a multi-paneled protective undergarment comprising: a ballistic resistant protective panel forming one panel of the undergarment; and a low thermal burden material snitched to the ballistic resistant resistive panel, the low thermal burden material forming complementary fabric panels of the undergarment; wherein the ballistic resistant panel and the low thermal burden material in combination structurally assemble into the undergarment.

Advantageously, the preferred embodiments provide a fully-flexible undergarment that exhibits anti-ballistic properties whilst being lightweight and allowing good leg mobility. The improved integral design of the protective undergarment ensures that a blast-protective, slash-proof (or "ballistic resistant") patch remains in place to protect the lower abdomen and especially the crotch, groin, inside regions along the upper thigh and significant areas around/of the buttocks. The undergarment of the preferred embodiments therefore offers increased protection to the common iliac artery, the external and internal iliac, and the femoral artery (as well as the profunda femorus and superficial femoral artery).

Preferably, the protective patch is of unitary construction and is externally stitched to a low thermal burden material, such as polyester mesh, that provides both a low thermal burden effect and elastic support. Front and back regions of the protective patch are typically not symmetrical, with a rear portion having a larger area that extends substantially across the buttocks.

In a preferred embodiment, the slash-proof material is realized by knitted Kevlar®. To reduce potential for skin irritation through rubbing, the protective panels are externally stitched to the low thermal burden material that completes the structure of the shorts. The Kevlar® knit is flexible and preferably lies near to (or directly against) the skin of a user to provide blast wave and ballistic fragment deflection whilst is limited overall areas permit mobility in the resultant lightweight undergarment.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF A PREFERRED EMBODIMENT

Figure 1:
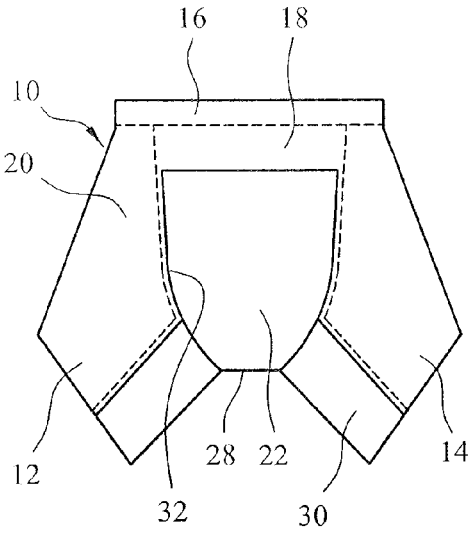
FIG. 1 is a front view of protective trunks according to a preferred embodiment of the present invention.
Figure 2:
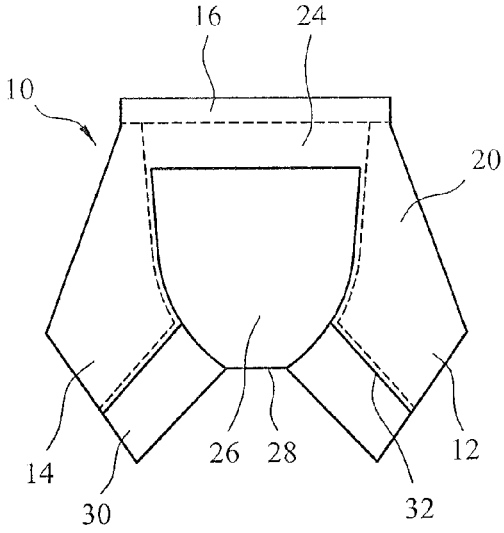
FIG. 2 is a rear view of the protective trunks of FIG. 1.
Figure 3:
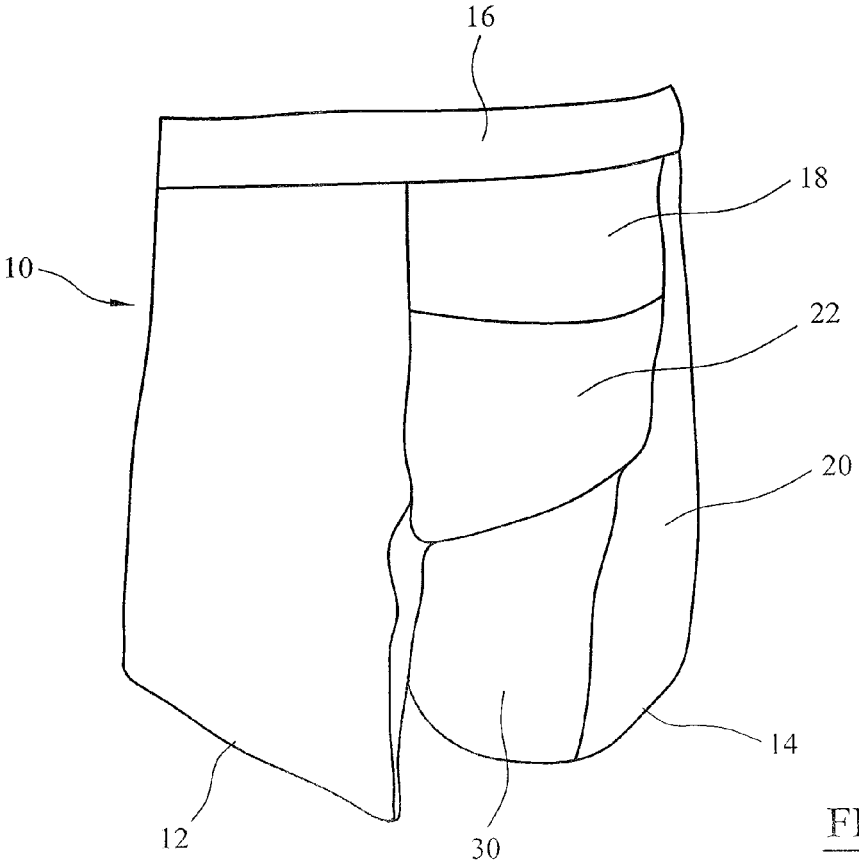
FIG. 3 is a front perspective view of the protective trunks of FIG. 1, the view showing further detail of supporting low thermal burden fabric.

Turning to FIGS. 1 to 3, there are shown various views of protective trunks 10 according to a preferred embodiment of the present invention. The terms "trunks" is not limiting and should be understood to include, and be interchangeable with, equivalent terms such as "boxers", "briefs", "shorts", "diapers" and "underpants".

The protective trunks 10, in a preferred embodiment, resemble cycling shorts in that legs 12, 14 extend, when worn, down the thighs of a user to close slightly above the knee and thus around the quadriceps and hamstrings of a wearer. A waistband 16 extends around the top of the trunks 10, which waistband is either elasticated and/or otherwise permits for fitting adjustment. At the front, beneath the waistband 16, a relatively narrow (but optional) waist panel 16 connects the waistband 16 to: i) outer leg side coverings 20; and ii) a front adnominal protective panel 22. At the back, beneath the waistband 16, a relatively narrow (but optional) lateral back panel 24 connects the waistband 16 to: i) the outer leg side coverings 18; and ii) a rear buttock protective panel 26 that extends across the buttocks and which extends downwardly to merge or connect to the front adnominal protective panel 22 in a saddle or crotch region 28.

The waist panel 18 and lateral back panel 24 therefore provide some flexibility in a torso region of the trunks 10, since these panels and the outer leg side coverings 18 are preferably made from a low thermal burden material, such as a polyester mesh or a combination of nylon and Lycra (or the like) which, also, preferably has good wicking properties. The waist panel 18, lateral back panel 24 and outer leg side coverings 18 function to compress the legs and tummy to help combat muscular fatigue and, furthermore, permit the trunks both to "breath" and to express perspiration (in the form of water vapour) through a cooling evaporative effect from the surface thereof. The waist panel 18, lateral back panel 24 and outer side legs may be formed of individual pieces that are stitched together or otherwise formed as larger, multi-functional pieces.

In addition to the front adnominal protective panel 22 and rear buttock protective panel 26, inside thigh protective panels 30 attach around the crotch region 28 and further attach, typically along as external seam, to outer leg side coverings 18 to form short trouser legs. The inside thigh protective panels 30 therefore extend along the inside of the thigh and join to (amongst other elements) the outer leg side coverings along seams 32 (shown in dotted outline in FIGS. 1 and 2).

From a constructional perspective, the front adnominal protective panel 22, rear buttock protective panel 26 and inside thigh protective panels 30 (which may collectively be formed as a single piece or otherwise in parts) are manufactured from an anti-ballistic or slash-proof material. For example, the protective panels may be made from a slash-proof material that complies with at least British Standard (BS) EN 388-6.2 blade cut level 2. In light of forming the protective panels (reference numerals 22, 26 and 30 in the figures) as an integral part of the trunk 10, there is no possibility for any of the protective panels to substantially move away from their intended positions within the garment; this contrasts with the prior arrangements where armour either is incorporated into a pouch or pocket or where a padding or lining is stitched into a pre-existing trouser. The protective panels therefore provide blast protect to the lower abdomen and especially the crotch, groin, inside regions of the upper thighs and significant areas of or around the buttocks. Indeed, in contrast with prior art systems that make use of downward hanging armour panels that only protect the groin region from lateral impacts arising from frontal assault, the protective panels of the preferred embodiments extend at least under the crotch and around the front and rear areas of the lower abdomen (i.e. groin and buttocks) and thus provide protection against blasts (e.g. from IEDs) from ground level.

Although FIGS. 1 to 3 show the front adnominal protective panel 22 and rear buttock protective panel 26 as being generally U-shaped, cup-shaped or chalice-shaped, their exact shape is determined from the degree of protection that is desired for the underlying body parts. That said, to maintain flexibility of movement, the protective panels generally only cover the vital arteries and organs in the lower belly/upper groin and also the genitalia. For example, the preferred arrangement for the inside thigh protective panels 30 of the trunks 10 offers increased protection to the common iliac artery, the external and internal iliac, and the femoral artery (as well as the profunda femorus and superficial femoral artery). Typically, therefore, the inside thigh protective panels 30 will be strip-shaped and surround about one-third of the leg. The rear buttock protective panel 26, in contrast with conventional briefs or boxer shorts, extends across the buttock regions to inhibit the effects of explosion shockwaves that otherwise enter the anal passage and which might cause significant harm to the colon.

In a preferred embodiment, the protective panels 22, 26 and 30 are made from knitted Kevlar® having a thickness of between about 2 mm and 3 mm. Different protective panels can have different thicknesses of this slash-proof material, e.g. front adnominal protective panel 22 for the groin region typically is made thicker than the inside thigh protective panels 30. In terms of slash-proof materials, the fabric "Quality K2815" by Dale Techniche with a weight of 360/380 grams per square meter (gsm) is one suitable material, with Quality K2815 being a heavier modified interlock knit fabric that is flame retardant and made from 100% Kevlar® fibre. While not wishing to be bound by theory, it is understood that the knitted configuration of Kevlar® has an increased shrapnel deflecting ability because the threads resist separation as compared to conventional materials in which the warp and weft are more easily teased apart (and thus penetrated) by ballistic fragments.

In other embodiments, alternative anti-slash/anti-ballistic materials other than Kevlar® may be used, which other materials may include Ultra-High Molecular Weight Polyethylenes (UHMwPE), such as Dyneema®. Multiple stacked layers (typically at least three) of silk twill or knitted silk having a weave weight of 100 gsm have also been found to perform, with natural fibres having an inherent advantage with respect to their ability to take up and dissipate water, i.e. their natural wicking capabilities. Also, in the event that the trunks are compromised by fragment damage, the generally inert nature of (clean) silk in body tissue is a known medical quantity.

To extend further the concept of using silk, a preferred embodiment makes use of silk (or another naturally strong material) to form both the low thermal burden ("support") material that forms, for example, the outer thigh areas and also thicker knitted or woven areas of silk for the protective areas 22, 26, 30. In this way, the trunks 10 have varying material weights of silk covering different body regions. For example, the areas of the trunks designed with a lower thermal burden (seen in FIGS. 1 and 2 as the darker/black areas) may therefore be composed from silk with a weight of between about 75 gsm and 115 gsm, with the protective panels 22, 26, 30 realized by layers of this same silk material that combine to produce an effective protective panel weight of silk in the region of between about 250 gsm and about 450 gsm and more preferably in the region of about 300 gsm to about 400 gsm. Knitted silk would provide for some degree of natural elasticity. Fitting of a silk-based trunk about the waist (and legs) could make use of a draw string and/or a corset-based cross-fastening to drawing the truck about the leg. Alternatively, a small percentage of an elastic fibre could be included in the weave/knit.

The mix of protective slash-proof materials and wicking materials that assemble to define the shape of the trunks 10 provides the wearer with a comfortable fit that has a degree of self-heat regulation and sweat dissipation. The breathability of the polyester mesh or a combination of nylon and Lycra (or the like) therefore offsets the generally higher thermal insulative properties of, for example, the Kevlar® knit.

It is preferred that the trunks 10 have no opening or "fly".

Protective panels (and, if desired, the wicking material) can be treated with both anti-bacterial and hypoallergenic agents (including silver-based compounds), thereby resisting odors and restricting the potential for bacterial or fungal growth.

In one particular embodiment, the protective patch may be further covered with a soft material membrane that, in use, lies against the skin and acts to commute perspiration away from the skin. Such a liner may be coated with an anti-microbial agent or anti-odour agent, with the liner being either fixed or removable from the protective patch. The lining can also act to reduce sensitivity. Other embodiments may be unlined but additional coverings represent an additional weight and an increased thermal burden.

The protective panels may be cut from a singular sheet of material, although another embodiment makes use of panels that are double-stitched together along peripheral edges of each panel. Stitching together of the various pieces of the trunks 10 is preferably realized by external flat stitching and an external seam that reduce opportunities for internal stitches to rub against bare skin.

It will, of course, be appreciated that the above description has been given by way of example only and that modifications in detail may be made within the scope of the present invention. For example, the precise composition of the supporting wicking material need not exactly follow a nylon-spandex mix, with the material rather needing to be strong, soft, durable and elastic. Also, in terms of overall length of the leg, it is merely preferred that the tight-fitting leg extends to above the knee with an opening generally surrounding the quadricep muscle and hamstring. The length of the leg of the undergarment could optionally be shorter or longer than that shown in the accompanying drawings, with the protective patch covering at least a sizeable portion of the inside thigh to provide protection of the upper track of the femoral artery in the leg.

Indeed, whilst a preferred embodiment refers to shorts, the principal of integrating one or more slash-proof regions (preferably in the form of a Kevlar knit or the like) with a elasticized wicking cloth can be applied to other undergarments, including vests or T-shirts, that selectively target blast protection of arteries (such as the axillary, anterior humeral circumflex, profunda brachii and brachial arteries) in the upper arm and shoulder.

While various embodiments of the present invention refer to use of a "wicking material", it is envisioned that this fabric, whilst preferably supporting a wicking effect, need not accomplish any wicking effect whatsoever. More importantly, however, is that the material surrounding the protective panels has a low thermal burden and, preferably, also be a strong and lightweight support fabric. The term "wicking" should therefore be viewed in this context.

The terms "anti-ballistic" or "ballistic resistant" should be construed in the sense of a strengthened material knit or weave that deflects or impedes ballistic fragment penetration, with the term "slash-proof" representing one type of material that is suitable for application in this context.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An anti-ballistic paneled protective pair of trunks comprising:

a torso region including front abdominal and back regions and a crotch region connecting said front abdominal and back regions, said crotch region being continuous with said front abdominal and back regions;

outer leg coverings comprising a low thermal burden material; and inner, upper thigh regions coupled to the outer leg coverings that together form legs in the protective trunks, said inner upper thigh regions extending downwardly and continuously from said crotch region along each leg;

an anti-ballistic protective region comprising at least one protective panel made from an antiballistic material, said anti-ballistic protective region extending continuously along the crotch region and extending:

downward and continuously from said crotch region along said inner, upper thigh region in each leg of the protective trunks; and upward and continuously from said crotch region across at least a lower part of said front abdominal and back regions, said anti-ballistic protective region providing an area of continuous blast resistance around and under the wearer's crotch, across the wearer's genitalia and over the wearer's anal passage and along the wearer's inner, upper thighs; and wherein said low thermal burden material is stitched or securely connected to said anti-ballistic protective region and said low thermal burden material is a fabric providing flexibility to the protective trunks, and wherein said anti-ballistic region and said low thermal burden material, in assembled combination, define structure of the protective trunks with said low thermal burden material securing said anti-ballistic protective region in place in the protective trunks.

2. The anti-ballistic paneled protective trunks of claim 1, wherein said anti-ballistic material is a knitted Kevlar.

3. The anti-ballistic paneled protective trunks of claim 1, wherein said anti-ballistic region comprises at least two protective panels.

4. The anti-ballistic paneled protective trunks of claim 1, wherein said anti-ballistic region is covered by a liner.

5. A multi-paneled protective undergarment comprising:

a torso region including front lower abdominal and back regions and a crotch region connecting said front lower abdominal and back regions;

outer leg coverings comprising a stretchable wicking fabric; and inner, upper thigh regions coupled to said outer leg coverings to form legs in the multi-paneled protective undergarment, said inner upper thigh regions extending downwardly and continuously from said crotch region;

a first knitted protective panel forming at least a lower part of said front lower abdominal and back regions of the multi-paneled protective undergarment and extending continuously underneath and around said crotch region of the multi-paneled protective undergarment;

a second knitted protective panel forming said inner, upper thigh region in each leg of the multi-paneled protective undergarment, said second protective panel merging or connecting to said first protective panel in said crotch region and wherein said second protective panel extends downwardly and continuously therefrom, wherein said first protective panel and said second protective panel comprise a flexible, anti-ballistic material providing continuous blast wave protection to at least said lower part of said front lower abdominal and back regions, around said crotch region, and along the inner, upper thigh regions that, when worn, lie juxtaposed femoral arteries of a wearer of the multi-paneled protective undergarment; and said stretchable wicking fabric merging or connecting to said second protective panel shaped at least to define said outer leg coverings of the multi-paneled protective undergarment, said stretchable wicking fabric arranged, when worn by the wearer, to compress an outer, upper thigh region of the wearer, said stretchable wicking fabric providing a structural element to the multi-paneled protective undergarment by holding said first protective panel and said second protective panel in place in the multi-paneled protective undergarment.

6. The multi-panel protective undergarment of claim 5, wherein at least one of said first knitted protective panel or said second knitted protective panel is stitched to the stretchable wicking fabric.

7. The multi-paneled protective undergarment of claim 5, wherein the multi-paneled protective undergarment comprises a pair of shorts.

8. The multi-paneled protective undergarment of claim 5, wherein at least a portion of each leg surrounds either the upper thigh of the wearer or a combination of the quadriceps muscle and hamstring of the wearer, and wherein each said second knitted protective panel is positioned to provide continuous the blast wave protection over the upper track of the femoral artery in the leg of the wearer.

9. The multi-paneled protective undergarment of claim 8, wherein the first knitted protective panel and the second knitted protective panel are comprised from a woven Kevlar.

* * * * *